United States Patent [19]

MacFarlane et al.

[11] 4,453,520

[45] Jun. 12, 1984

[54] LIQUID FUEL PUMPING APPARATUS

[75] Inventors: Charles T. MacFarlane, London; Graham L. Adams, Potters Bar, both of England

[73] Assignee: Lucas Industries Limited, Birmingham, England

[21] Appl. No.: 276,683

[22] Filed: Jun. 23, 1981

[30] Foreign Application Priority Data

Jul. 3, 1980 [GB] United Kingdom ..... 8021835

[51] Int. Cl.[3] ..... F02D 7/00

[52] U.S. Cl. ..... 123/387; 123/366; 123/367; 123/374

[58] Field of Search ..... 123/387, 386, 385, 379, 123/366, 369, 367, 374, 373

[56] References Cited

U.S. PATENT DOCUMENTS

| | | | |
|---|---|---|---|
| 2,165,657 | 7/1939 | Schaeren | 123/387 |
| 2,868,184 | 1/1959 | Moulton | 123/386 |
| 3,049,867 | 8/1962 | Gillespie | 123/387 |
| 3,530,845 | 9/1970 | Staudt et al. | 123/374 |
| 3,640,258 | 2/1972 | Isobe et al. | 123/385 |
| 3,667,439 | 6/1972 | Muir | 123/387 |
| 3,814,072 | 6/1974 | Gillespie | 123/366 |
| 3,902,470 | 9/1975 | Tomsett | 123/373 |
| 4,223,653 | 9/1980 | Jaenke | 123/366 |

FOREIGN PATENT DOCUMENTS

| | | | |
|---|---|---|---|
| 1375841 | 11/1974 | United Kingdom | 123/387 |

*Primary Examiner*—Ira S. Lazarus
*Assistant Examiner*—Magdalen Moy

[57] ABSTRACT

A liquid fuel pumping apparatus includes a centrifugal weight mechanism 14 which is coupled to a fuel control member through a lever. A spring is provided to oppose the action of the weight mechanism and this is coupled through a lever having an adjustable pivot point, to the lever through a closure member carried about an axially movable member coupled to the weight mechanism. A drilling in the member is supplied with liquid under pressure at a restricted rate. The pressure of liquid acts upon the closure member to urge the closure member relative to the member so as to uncover a groove communicating with the drilling. The pressure of liquid in the drilling is controlled so that it varies in accordance with the square of the speed and in the event that the pressure fails the closure member and the axially movable member will move relative to each other to cause a reduction in the fuel supplied by the apparatus.

9 Claims, 6 Drawing Figures

LIQUID FUEL PUMPING APPARATUS

This invention relates to a liquid fuel injection pumping apparatus for supplying fuel to an internal combustion engine and of the kind comprising an injection pump operable in timed relationship with an associated engine, a mechanical governor mechanism including a weight which moves outwardly as the speed of the associated engine is increased, to effect movement of an axially movable member, means responsive to the position of the member for varying the amount of fuel delivered by the injection pump whereby as the member is moved by the weight the amount of fuel supplied by the pump will be decreased, resilient means for opposing the movement of said member, valve means associated with said member for controlling a fluid pressure so that the pressure varies as the square of the speed of the associated engine and pressure responsive means to which fluid at said pressure is supplied for controlling an operating parameter of the pump.

One form of such an apparatus is shown in the specification of British Pat. No. 1,478,294. In this apparatus the axially movable member forms part of a throttle which controls the amount of fuel delivered by the injection pump and the pressure responsive means comprises a spring loaded piston which by its position determines the maximum amount of fuel which can be supplied by the apparatus so that it varies in accordance with the speed. The aforesaid valve means comprises a drilling in the axially movable member which opens to the end of the member. The drilling communicates with a source of fuel under pressure by way of a restriction, and the open end of the drilling is closed by a movable closure element which is held against the end of the valve member to close the open end of the drilling, by the aforesaid resilient means. The drilling also communicates with said pressure responsive means. In operation, the pressure of fuel in the drilling acts to lift the closure element from the open end of the drilling so that the pressure of fuel in the drilling varies in accordance with the square of the speed of the associated engine. The extent of movement of the closure element away from the end of the member is very small.

In the event of a sufficient reduction in the pressure of the fuel supplied to the drilling, the pressure in the drilling will no longer be controlled to the desired value and so the position of the piston will no longer be correct for the speed of the associated engine. Fuel can however continue to flow to the engine. It is desirable to provide a positive indication to the operator that some malfunction has occurred and this is best achieved by causing a significant reduction in the engine speed.

The object of the present invention is to provide an apparatus of the aforesaid kind in a form in which this desideratum is achieved.

According to the invention in an apparatus of the kind specified said valve means comprises a drilling formed in said member and opening to one end thereof, a restriction through which fluid under pressure can be supplied to said drilling, a port formed in the wall of said valve member, said port being in communication with said drilling, a closure member slidable on said end of the member and having a skirt portion which can cover said port, said resilient means acting on said closure member whereby in use, the fluid pressure acting on the closure member will move the closure member relative to the valve member to partly uncover said port to control the fluid pressure in the drilling so that it varies in accordance with the square of the speed and in the event of a significant reduction of the pressure of fluid supplied to said drilling, the closure member will move relative to said member under the force produced by the weight to reduce the amount of fuel supplied by the pump.

According to a further feature of the invention a light spring is provided intermediate the axially movable member and the closure member, said spring acting in conjunction with the weight to control the speed of the associated engine at a low value.

An example of a fuel pumping apparatus incorporating the invention, will now be described with reference to the accompanying drawings.

Figure 1:
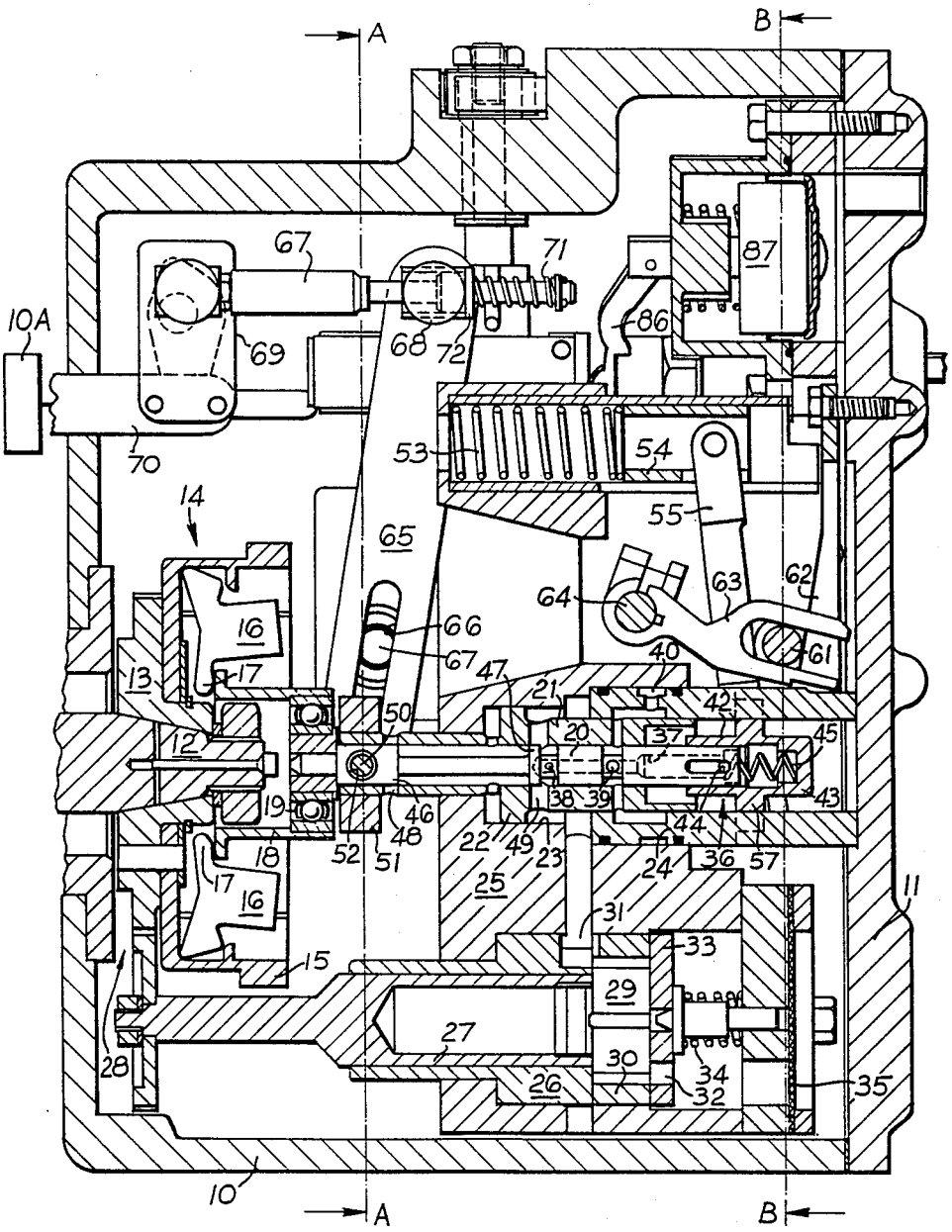
FIG. 1 is a sectional side elevation of the governor portion of the apparatus taken on the line CC of FIG. 2.

Referring to the drawings the governor mechanism of the apparatus comprises a two part housing 10, 11 the part 11 in effect forming an end closure for the part 10. The part 10 of the housing is adapted to be secured to the body 10A of a fuel injection pump and extending into the housing is an extension of a drive shaft 12 of the pump which has a tapered portion which receives the boss 13 of a governor weight mechanism generally indicated at 14. The weight mechanism includes a cup-shaped cage 15 which locates a plurality of pivotal weights 16. The weights have toe portions 17 engageable with the end face of a sleeve 18 which is axially movable within the housing and which mounts a ball thrust bearing 19.

The centre portion of the bearing 19 supports an axially movable servo valve member 20 which is slidable within a piston assembly 21. The piston assembly includes a piston 22 slidable within a cylinder 23 and the remaining portion of the piston assembly which is of reduced diameter, is housed within a sleeve 24 fixed within a casting 25 mounted within the housing.

The aforesaid casting also mounts a sleeve 26 which carries a hollow shaft 27 adapted to be driven at a speed greater than the shaft 12 through gearing generally indicated at 28. The shaft 27 is connected in the rotor 29 of a vane type pump which includes a stator 30. The sleeve 26 defines an outlet 31 and an inlet 32 is formed in a plate 33 which is biassed by means of a spring 34 into engagement with the adjacent end face of the stator 30. Oil or hydraulic fluid conveniently fuel, is drawn by the pump through the inlet 32 through a filter 35, from the interior of the housing.

The outlet 31 of the vane pump is in communication with a cylinder 23 so that the outlet pressure of the pump acts upon the piston 22 in a direction to urge it towards the left as seen in FIG. 1. In addition, valve means 36 is provided to derive from the outlet of the pump a pressure which varies in accordance with the square of the speed at which the shaft 12 is driven. This valve means includes a portion of the servo valve member 20. It will be observed that the servo valve member is provided with a drilling 37 which extends inwardly from the end of the servo valve member remote from the weight mechanism. The drilling communicates with the outlet of the pump 31 by way of a restricted orifice 38 and it also communicates with a circumferential groove on the valve member by way of a drilling 39 of substantial diameter formed in the valve member. The aforesaid groove is in constant communication with a pair of radial ports formed in the piston assembly and these in turn are in constant communication with a circumferential groove 40 formed in the periphery of the sleeve member 24. The drilling 37 also communicates with a pair of axially extending slots 41 formed in the side wall of the valve member and the slots 41 can be obturated by the skirt portion 42 of an axially movable closure member 43. The slots 41 also accommodate a transversely extending pin 44 which is carried by the skirt portion 42. In addition, a coiled compression spring 45 acts intermediate the valve member 20 and the closure member 43, the pin 44 co-operating with the ends of the slots 41 to limit the extension of the spring 45.

The control of the pressure on the left hand side of the piston 22 is effected by the servo valve and in particular by a pair of lands 46, 47 which define between them an annular space in constant communication with the portion of the cylinder 23 lying to the left of the piston 22. The piston assembly defines ports 48, 49 which in an equilibrium position of the valve member and piston assembly are covered by the lands 46 and 47 respectively. The ports 48 communicate with the interior of the housing whilst the port 49 communicates with the outlet of the pump 31. It should be noted that the port 49 is not completely closed by the land 47 since the port 49 also acts to convey the oil to the drilling 37 by way of the restricted drilling 38. In operation, if from an equilibrium position the valve member 20 is displaced towards the right, the port 49 will be placed in communication with the annular space defined between the lands and therefore with the left hand end of the cylinder 23. Oil under pressure will therefore flow into the left hand end of the cylinder and since the effective area of the piston exposed to the pressure in the left hand end of the cylinder is greater than that exposed to the pressure in the right hand end of the cylinder, the piston will move towards the right until such time as the port 49 is again closed by the land 47. If on the other hand the valve member is moved towards the left, then the port 48 will be uncovered by the land 46 to allow oil to be forced out of the left hand end of the cylinder. The piston 22 can therefore move towards the left and such movement continues until the land 46 again covers the port 48. The valve member 20 and the piston assembly therefore constitute a follow up servo system.

The extent of relative movement of the valve member and the piston is determined by a pin 50 which secures a collar 51 to the piston assembly. The pin 50 passes with clearance through aligned apertures 52 formed in the portion of the valve member forming the land 46.

Figure 2:
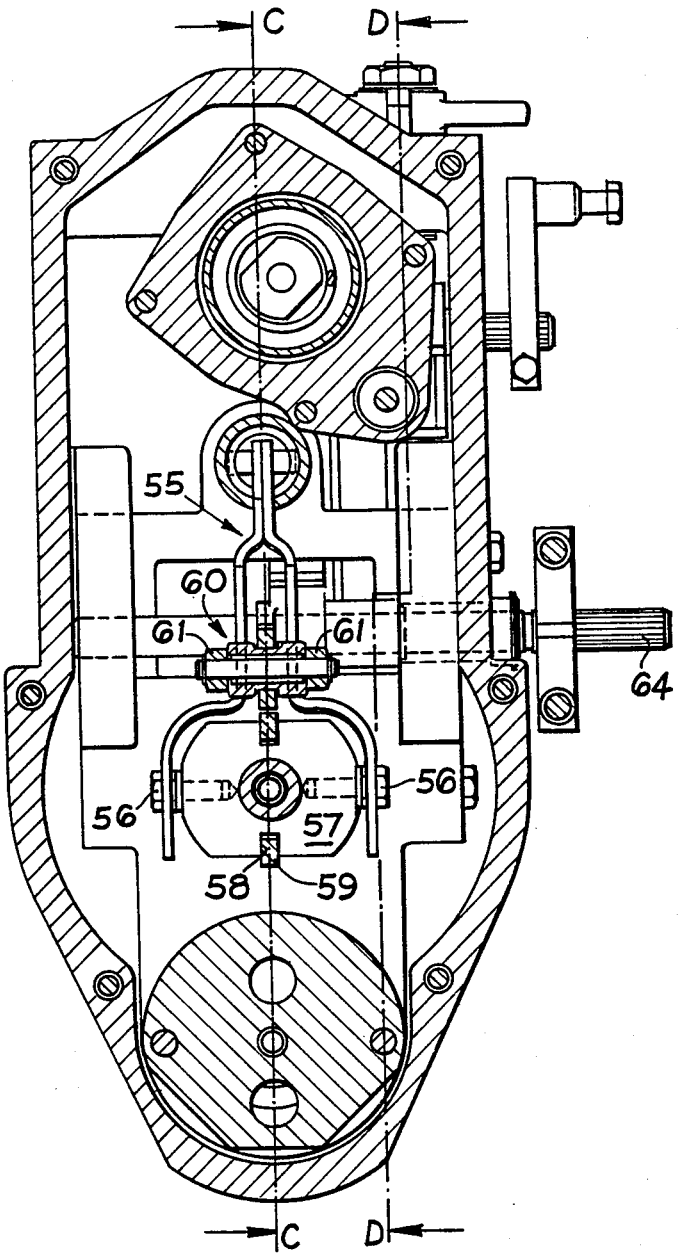
FIG. 2 is a section on the line BB of FIG. 1.
Figure 3:
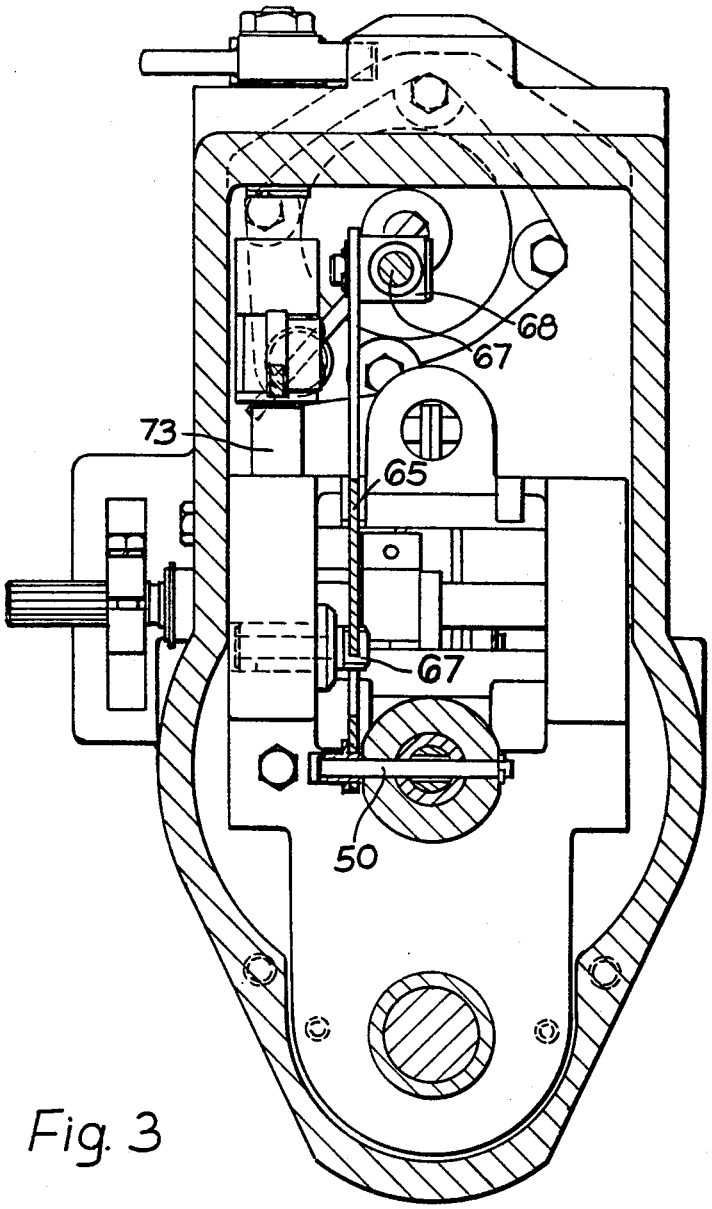
FIG. 3 is a section on the line AA of FIG. 1.

It was mentioned above that when the port 48 was uncovered by the land 46, the piston assembly could move towards the left. Such movement of the valve member is effected by the action of a governor spring 53. One end of the spring bears against a fixed abutment whilst the other end bears against a slidable member 54 which is pivotally connected to one end of a lever 55. As shown in FIG. 2, the lever 55 is formed in two parts of opposite hand. The parts of the lever 55 remote from the spring 53 are forked and embrace abutments 56 which are carried by a flange portion 57 secured to the closure member 43 of the valve means 36. The flange 57 is provided with slots 58 in which are located portions 59 of the sleeve 24.

Intermediate its ends, the lever 55 engages a roller assembly generally indicated at 60 in FIG. 2 and which includes rollers 61 engageable with ramp surfaces 62 formed on or secured to the housing portion 11. The position of the roller assembly 60 on the ramp can be adjusted by means of an angularly movable lever 63 which is mounted upon a shaft 64 extending to the exterior of the housing. As the lever 63 is moved it will be noted that the position of the pivot of the lever 55 varies but as the roller assembly is moved downwardly as shown in FIG. 1, the force exerted by the spring 53 on the closure member 43 will increase.

It is now appropriate to describe the operation of the valve means 36 and for this purpose it is assumed that the shaft 12 is rotating at a constant speed, and that there is no movement of the roller assembly 61. The oil under pressure within the drilling 37 acts upon the closure member 43 to move the closure member 43 towards the right as shown in FIG. 1. This movement is assisted by the action of the spring 45. When however the skirt 42 uncovers the ends of the grooves 41, oil will be released from the drilling 37 and because of the restriction offered by the drilling 38, the oil pressure therein will fall and the closure member 43 and valve member 20 will assume an equilibrium position with the force exerted by the oil pressure acting on the closure member 43 just balancing the force exerted by the governor weights 16 and also the force applied to the closure member 43 by the spring 53. If now the speed of rotation of the shaft increases, the force exerted by the governor weights 16 will increase and momentarily there will be a movement of the valve member 20 towards the right as shown in FIG. 1. This movement will effectively close the groove 41 so that the oil pressure in the drilling 37 will rise until once again the force exerted by the oil under pressure on the closure member 43 balances the force exerted by the governor weights. Since the weights will be exerting a greater force with the increased speed, the closure member 43 will be moved further towards the right against the action of the spring 53, however so far as the pressure of oil within the drilling 37 is concerned the variation in oil pressure will be related to the square of the speed at which the shaft 12 is rotating. The oil pressure in the drilling 37 therefore varies in accordance with the square of the speed at which the shaft 12 is rotating. During this explanation we have omitted any reference to the spring 45. This spring does in fact assist the action of the oil pressure in moving the closure member in a direction to expose the groove 41. Thus the actual pressure in the drilling 37 will be less than would be the case if the spring 45 were omitted. The reason for the provision of the spring 45 will be described later in the specification.

The collar 51 is pivotally connected by means of the pin 50, to the end of a lever 65 in which is formed a slot 66 which locates upon a pivotal abutment 67 carried by the aforesaid casting. The other end of the lever 65 carries a bush 68 through which extends a rod 67 mounted on a plate 69 secured to the fuel control rod 70 of the associated injection pump. The rod 67 carries on its end remote from the plate 69, an abutment for a coiled compression spring 71 which engages the flanged portion of a bush 72 slidable within the bore formed in the bush 68.

The basic operation of the governor mechanism can now be described it being understood that the movement of the collar 51 which is connected to the piston assembly, upon movement of the weights 16 has already been described. If for a given setting of the roller assembly 61, the speed of operation of the associated engine increases, the weights 16 will move outwardly thereby resulting in movement of the collar 51 towards the right and movement of the lever 65 in an anti-clockwise direction to effect movement of the control rod 70 towards the left, that is to say in a direction to reduce the amount of fuel supplied to the engine. Conversely if the speed of the associated engine falls then the weights 16 will be moved inwardly by the action of the spring 53 and the collar 51 will move towards the left thereby allowing clockwise movement of the lever 65 which results in movement of the control rod 70 towards the right, thereby increasing the amount of fuel supplied to the engine to maintain the speed of the engine substantially constant.

If the roller assembly is moved downwardly then the force exerted by the governor spring 53 in opposition to the force exerted by the weight assembly, will increase and the collar 51 will move towards the left resulting in an increase in the amount of fuel supplied to the engine. Conversely, if the roller assembly is moved upwardly then the force exerted by the governor spring 53 is reduced and the weights are allowed to move outwardly thereby causing a reduction in the amount of fuel supplied to the engine.

As previously mentioned, moving the roller assembly 61 alters the pivot point of the lever 55 and with the arrangement shown when the roller assembly 61 is in its uppermost position, the load on the governor spring 53 is low and the effective governor rate is low. On the other hand when the roller assembly is in its lowermost position as shown, the load on the governor spring is high and the effective governor rate is high.

It is possible to reverse the ramp surfaces 62 so that for engine idling, the roller assembly 61 would be in the lowermost position. With this arrangement therefore for idling purposes the load on the governor spring is low but the effective governor rate is high and at high speeds, the load on the governor spring will be high but the effective governor rate will be low.

Figure 4:
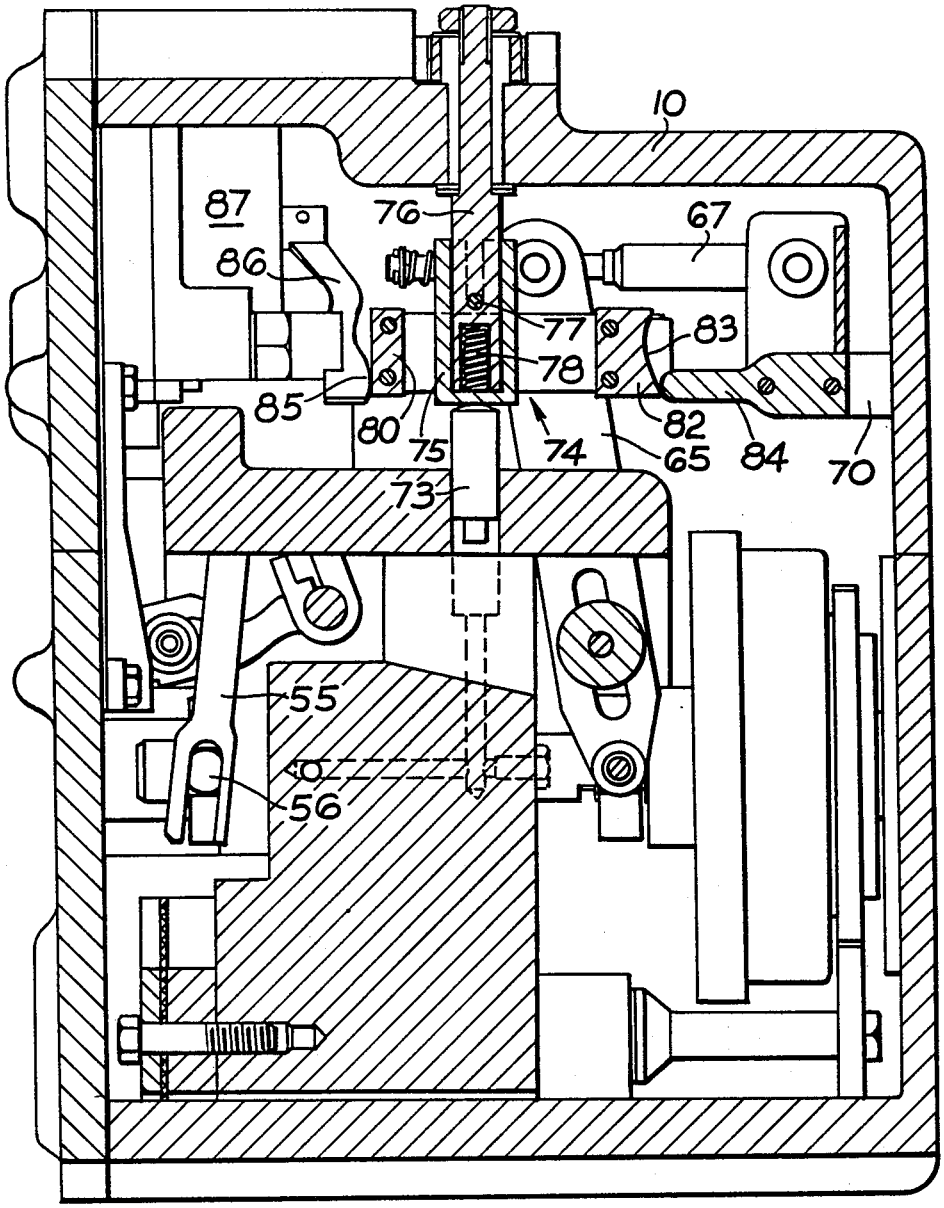
FIG. 4 is a section on the line DD of FIG. 2.
Figure 5A:
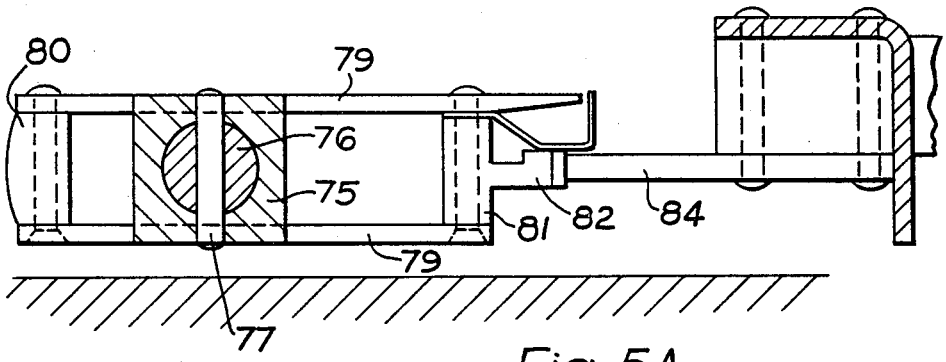
FIGS. 5A and 5B are plan views of a portion of the apparatus shown in the remaining drawings, in different settings.
Figure 5B:
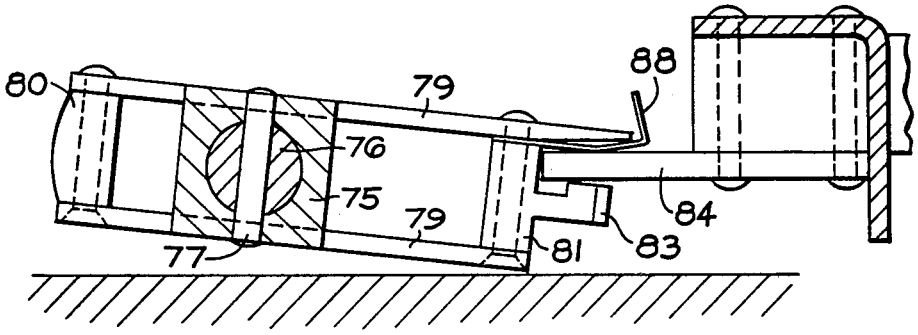

The pressure in the aforesaid circumferential groove 40 is utilised to position a piston 73 which forms part of a torque control generally indicated at 74. The piston 73 engages in end to end relationship, a block 75 which is provided with a cylindrical bore in which is located a cylindrical guide member 76 secured in the wall of the housing. A pin 77 is carried by the guide and locates within slots formed in the block 75 so as to prevent relative angular movement of the block and the guide. The guide however is angularly movable from the exterior of the housing as is shown in FIGS. 5A and 5B. The block 75 is biassed into engagement with the piston by means of a coiled compression spring 78 and the block 75 defines guide channels for a pair of plates 79. Sandwiched between the end portions of the plates 79 are a pair of members 80, 81 respectively and conveniently the plates are riveted to the aforesaid members. The plates can move relative to the block 75 in the horizontal direction as shown in FIG. 4. The member 81 carries a projection 82 on which is formed a cam surface 83 and this is engageable by means of a follower 84 which is secured to the control rod 70. The member 80 is engageable with an abutment 85 which may be a fixed abutment or as shown, comprises a surface formed on a pivotally mounted lever 86, the setting of which is determined by an air pressure responsive device generally indicated at 87. This may be a device responsive to the altitude at which the associated engine is operating or it may be responsive to the pressure of air in the inlet manifold of the associated engine.

The surface 83 constitutes a maximum fuel stop and it will be seen that as the pressure in the circumferential groove 40 varies so the block 75 and the plates 79 together with the member 82 will move downwardly, it being shown in the uppermost position. Such downward movement will by virtue of the shape of the surface 83, permit an increased amount of fuel to be supplied to the engine. The maximum fuel delivery of the engine is therefore varied in accordance with the speed of the engine thereby giving what is termed in the art, torque control. An additional control of the maximum fuel quantity will be obtained by movement of the lever 86 and in general, as the pressure of air in the inlet manifold of the engine increases, so the maximum amount of fuel which can be supplied to the engine will be increased.

In order to obtain an excess of fuel for starting purposes, the guide 76 is moved angularly to the position shown in FIG. 5B. This disengages the projection 84 from the surface 83 and allows the control rod to move further to increase the amount of fuel supplied to the engine. A spring 88 is provided which is stressed by the projection 84 during its movement to the excess fuel position and this spring acts to restore the guide and block to the position shown in FIG. 5A once the engine has started and the control rod has been moved by the governor mechanism to reduce the amount of fuel supplied by the engine. The purpose of the spring 71 is to permit the lever 65 to move in the clockwise direction in the event that movement of the control rod is prevented by the maximum fuel stop. In this connection it will be appreciated that the effort required to move the lever 65 is derived from the oil under pressure acting upon the piston and the spring 71 acts to minimise the stress on the various parts in the event that the control rod 70 cannot move.

We turn now to the function of the spring 45. As has been explained above, the output pressure of the vane pump is utilised to provide servo power to determine the setting of the lever 65 and it is also used by way of the valve means 43 to effect movement of the piston 73, it is essential that in the event of failure of the pump that a reduced amount of fuel be supplied to the engine. In the event of the failure of the oil pressure the closure member 43 will move relative to the valve member 20 by a distance as permitted by the length of the slot 41. This movement will be achieved in part by a relaxing of the governor spring and therefore pivotal movement of the lever 55, and by movement of the weights 16 in the outward direction as the restraining force is reduced. By virtue of the pin 50 which will co-operate with the wall of the aperture 52, anti-clockwise movement of the lever 65 as shown in FIG. 1, will take place thereby reducing the amount of fuel supplied to the engine. In order to ensure that the engine will continue to operate at a low speed, the spring 45 is provided and it in effect acts as a governor spring at these low speeds, thus as the engine speed reduces in the absence of oil pressure, a point will be reached at which the force exerted by the weights 16 balances the force exerted by the spring 45 and a low speed governing action will be obtained. The spring 45 also acts to transmit to the valve member 20 and hence the lever 65, from the lever 55, the necessary force required to move the various parts to the excess fuel position for the purpose of starting the associated engine.

We claim:

1. A fuel injection pumping apparatus for supplying fuel to an internal combustion engine and of the kind comprising an injection pump operable in timed relationship with an associated engine, a mechanical governor mechanism including a weight which moves outwardly as the speed of the associated engine is increased, to effect movement of an axially movable member, means responsive to the position of the member for varying the amount of fuel delivered by the injection pump whereby as the member is moved by the weight the amount of fuel supplied by the pump will be decreased, resilient means for opposing the movement of said member, valve means associated with said member for controlling a fluid pressure so that the pressure varies as the square of the speed of the associated engine and pressure responsive means to which fluid at said pressure is supplied for controlling an operating parameter of the pump, said valve means comprising a drilling formed in said member and opening to one end thereof, a restriction through which fluid under pressure can be supplied to said drilling, a port formed in the wall of said valve member, said port being in communication with said drilling, a closure member slidable on said end of the member and having a skirt portion which can cover said port, said resilient means acting on said closure member whereby in use, the fluid pressure acting on the closure member will move the closure member relative to the valve member to partly uncover said port to control the fluid pressure in the drilling so that it varies in accordance with the square of the speed and in the event of a significant reduction of the pressure of fluid supplied to said drilling, the closure member will move relative to said member under the force produced by the weight to reduce the amount of fuel supplied by the pump.

2. An apparatus according to claim 1 including a light spring disposed intermediate the axially movable member and the closure member, said spring acting in conjunction with the weight to control the speed of the associated engine at a low value when the pressure of fluid supplied to said drilling is low.

3. An apparatus according to claim 2 including a piston slidable within a cylinder, linkage means coupling said piston to the means which varies the amount of fuel supplied by the injection pump, said axially movable member acting to control the pressure of fluid applied to said piston.

4. An apparatus according to claim 3 in which said piston forms part of a piston means which defines a bore through which said axially movable member extends, said axially movable member carrying a pair of spaced lands, and a pair of ports controlled by said lands respectively and through which fluid can flow to or from one end of said cylinder.

5. An apparatus according to claim 4 including a transverse pin carried by said piston means, an aperture in said axially movable member, said pin extendig through said aperture and defining a clearance with the wall of the aperture.

6. An apparatus according to claim 5 including a maximum fuel stop operable to determine the maximum amount of fuel which can be supplied by the apparatus.

7. An apparatus according to claim 6 in which said maximum fuel stop comprises a contoured surface defined on an adjustable part, said contoured surface being engaged by a projection associated with the means which varies the amount of fuel supplied by the injection pump.

8. An apparatus according to claim 7 including a piston for effecting movement of said adjustable part, said piston being responsive to the pressure of liquid in said drilling.

9. An apparatus according to claim 8 including means for pivoting said adjustable part to allow said projection to move to a position in which an excess of fuel is supplied by the apparatus for starting purposes.

* * * * *